US011148915B2

(12) United States Patent
Caldwell

(10) Patent No.: US 11,148,915 B2
(45) Date of Patent: Oct. 19, 2021

(54) BOOM ASSEMBLY AND METHOD OF ASSEMBLY THEREOF

(71) Applicant: Caterpillar Inc., Peoria, IL (US)

(72) Inventor: Curtis John Caldwell, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 179 days.

(21) Appl. No.: 16/576,414

(22) Filed: Sep. 19, 2019

(65) Prior Publication Data

US 2021/0087026 A1 Mar. 25, 2021

(51) Int. Cl.

| | |
|---|---|
| ***B66C 23/36*** | (2006.01) |
| ***B66F 11/04*** | (2006.01) |
| ***B66C 23/44*** | (2006.01) |
| ***E02F 3/36*** | (2006.01) |
| ***E02F 3/38*** | (2006.01) |

(52) U.S. Cl.

CPC ..... *B66C 23/36* (2013.01); *B66F 11/04* (2013.01); *E02F 3/369* (2013.01); *E02F 3/382* (2013.01); *B66C 23/44* (2013.01); *B66C 2700/01* (2013.01)

(58) Field of Classification Search

CPC ..... B66C 23/36; B66C 23/44; B66C 23/66; B66C 2700/01; E02F 3/369; E02F 3/382; B66F 11/04

See application file for complete search history.

(56) References Cited

U.S. PATENT DOCUMENTS

| | | | | | |
|---|---|---|---|---|---|
| 1,925,169 | A * | 9/1933 | Berg | B66C 23/36 | 212/195 |
| 1,985,285 | A * | 12/1934 | Erdahl | B66C 23/44 | 212/196 |
| 2,077,741 | A * | 4/1937 | Cardwell | B66C 23/36 | 212/172 |
| 2,261,870 | A * | 11/1941 | Cardwell | B66C 23/76 | 212/196 |
| 2,413,529 | A * | 12/1946 | Swaney | B66C 23/44 | 212/258 |
| 2,425,663 | A * | 8/1947 | Wooldridge | B66C 23/44 | 212/288 |

(Continued)

FOREIGN PATENT DOCUMENTS

| | | |
|---|---|---|
| CN | 201737581 | 2/2011 |
| CN | 202415014 | 9/2012 |

(Continued)

*Primary Examiner* — Michael R Mansen
*Assistant Examiner* — Juan J Campos, Jr.

(57) ABSTRACT

A boom assembly for a pipelayer includes a boom member having a first end and a second end. The boom assembly includes a first boom block adapted to be removably coupled to the second end of the boom member. The boom assembly includes a second boom block adapted to be removably coupled to a chassis of the pipelayer. The boom assembly includes a first hook block adapted to be removably coupled to the second end of the boom member. The boom assembly includes a second hook block adapted to be operably coupled to the first hook block. The boom assembly also includes a first lifting connector disposed on the first boom block and a second lifting connector disposed on the first hook block. Each of the first lifting connector and the second lifting connector is adapted to removably receive a lifting strap therethrough.

20 Claims, 10 Drawing Sheets

(56) References Cited

U.S. PATENT DOCUMENTS 2,712,873 A * 7/1955 Peterson ..... B66C 23/44 212/258
2,722,320 A * 11/1955 Carlson ..... B66C 13/18 212/196
3,058,600 A * 10/1962 Gosnell ..... B66C 23/44 212/203
3,426,915 A * 2/1969 Tesch ..... B66C 23/44 212/300
3,815,478 A * 6/1974 Axelsson ..... B66D 1/08 91/497
4,666,049 A 5/1987 Gilmore, Jr. et al.
5,332,110 A * 7/1994 Forsyth ..... B66C 23/44 212/196
5,392,936 A * 2/1995 Solomon ..... B66C 23/44 212/258
5,992,655 A * 11/1999 Greenberg ..... B66C 23/44 212/258
6,000,563 A * 12/1999 Greenberg ..... B66C 23/44 212/258
2003/0015488 A1* 1/2003 Forsyth ..... B66C 23/44 212/258
2004/0033109 A1* 2/2004 Gelmi ..... B66C 23/44 405/174
2006/0245888 A1* 11/2006 Dietz ..... B66C 23/44 414/563
2009/0084748 A1* 4/2009 Styck ..... B66C 23/44 212/258
2009/0087266 A1* 4/2009 Styck ..... B66C 23/44 405/154.1
2010/0061808 A1* 3/2010 Smith ..... B66C 23/26 405/184.4
2010/0140016 A1 6/2010 Raappana
2019/0023538 A1* 1/2019 Pletz ..... E03F 3/06
2019/0031474 A1* 1/2019 Stilborn ..... B66C 13/16
2019/0033158 A1* 1/2019 Bonnet ..... B66C 23/44
2019/0337776 A1* 11/2019 Fanello ..... B66D 1/54
2019/0352148 A1* 11/2019 Fanello ..... B66C 9/00
2020/0385246 A1* 12/2020 Dunn ..... B66C 23/64
2021/0101788 A1* 4/2021 Caldwell ..... B66C 23/905

FOREIGN PATENT DOCUMENTS

CN 203555690 4/2014
CN 206970051 2/2018
CN 208361756 1/2019

* cited by examiner

BOOM ASSEMBLY AND METHOD OF ASSEMBLY THEREOF

TECHNICAL FIELD

The present disclosure relates to a boom assembly. More particularly, the present disclosure relates to the boom assembly for a machine, such as a pipelayer, and a method of assembling the boom assembly on the machine.

BACKGROUND

A machine, such as a pipelayer, includes a boom assembly for lifting and lowering loads during a pipelaying operation. The boom assembly includes a number of components, such as a boom member, an upper boom block, a lower boom block, an upper hook block, a lower hook block, and so on. Typically, during transportation of the machine from one location to another location, the boom assembly is disassembled at one location and transported to a desired location in a disassembled configuration relative to the machine. The boom assembly is then reassembled on the machine at the desired location prior to the pipelaying operation.

During assembly, the upper boom block is lifted using a lifting rope and a lifting machine, such as an excavator or crane, in order to couple the upper boom block to the boom member. In many situations, the lifting rope is wrapped and secured around the upper boom block by one or more protrusions on the upper boom block, such as protruding edges, protruding bolts and nuts, and so on. Also, during assembly, the upper hook block is lifted using the lifting rope and the lifting machine in order to couple the upper hook block to the boom member. In many situations, the lifting rope is wrapped and secured around the upper hook block by one or more protrusions on the upper hook block, such as protruding edges, protruding bolts and nuts, and so on.

However, such an arrangement of securing the lifting rope around the upper boom block and the upper hook block is a potential safety hazard. More specifically, during lifting, the upper boom block and/or the upper hook block may slip from the respective lifting rope. As such, the upper boom block and/or the upper hook block may fall from a substantial height and may be damaged. In some situations, the upper boom block and/or the upper hook block may fall on the machine, in turn, damaging the machine. In some situations, the upper boom block and/or the upper hook block may fall, in turn, forming a pinch point between the upper boom block and nearby personnel or equipment, and/or between the upper hook block and nearby personnel or equipment. Hence, there is a need for an improved boom assembly and an improved method for assembling the boom assembly on the machine.

U.S. Pat. No. 4,666,049 discloses an articulated arm-type excavator machine. The machine includes a hydraulically actuated main boom and a side boom detachably mounted at a proximal end to a side of the machine. The machine also includes a trolley arrangement on an underside of the main boom. A detachable side boom arrangement enables the machine to be employed either as an excavator or as a side boom lifting device.

SUMMARY OF THE DISCLOSURE

In an aspect of the present disclosure, a boom assembly for a pipelayer is provided. The boom assembly includes a boom member having a first end and a second end. The second end is disposed opposite to the first end. The first end of the boom member is adapted to be removably coupled to an undercarriage of the pipelayer. The boom assembly includes a first boom block adapted to be removably coupled to the second end of the boom member. The boom assembly includes a second boom block adapted to be removably coupled to a chassis of the pipelayer. The second boom block is operably coupled to the first boom block using at least one first cable. The boom assembly includes a first hook block adapted to be removably coupled to the second end of the boom member. The first hook block is disposed opposite to the first boom block. The boom assembly includes a second hook block adapted to be operably coupled to the first hook block using at least one second cable. The boom assembly also includes a first lifting connector disposed on the first boom block. The boom assembly further includes a second lifting connector disposed on the first hook block. Each of the first lifting connector and the second lifting connector is adapted to removably receive a lifting strap therethrough.

In another aspect of the present disclosure, a pipelayer is provided. The pipelayer includes a chassis and an undercarriage coupled to the chassis. The pipelayer includes a boom member having a first end and a second end. The second end is disposed opposite to the first end. The first end of the boom member is adapted to be removably coupled to the undercarriage. The pipelayer includes a first boom block adapted to be removably coupled to the second end of the boom member. The pipelayer includes a second boom block adapted to be removably coupled to the chassis. The second boom block is operably coupled to the first boom block using at least one first cable. The pipelayer includes a first hook block adapted to be removably coupled to the second end of the boom member. The first hook block is disposed opposite to the first boom block. The pipelayer includes a second hook block adapted to be operably coupled to the first hook block using at least one second cable. The pipelayer also includes a first lifting connector disposed on the first boom block. The pipelayer further includes a second lifting connector disposed on the first hook block. Each of the first lifting connector and the second lifting connector is adapted to removably receive a lifting strap therethrough.

In yet another aspect of the present disclosure, a method for assembling a boom assembly on a pipelayer is provided. The method includes aligning a first end of a boom member relative to an undercarriage of the pipelayer. The method includes hingedly coupling the first end of the boom member to the undercarriage. The method includes providing a first lifting connector on a first boom block. The method includes providing a first lifting strap through the first lifting connector. The method includes lifting the first boom block using the first lifting strap by the first lifting connector. The method includes aligning the first boom block relative to a second end of the boom member. The method includes hingedly coupling the first boom block to the second end of the boom member. The method includes providing a second lifting connector on a first hook block. The method includes providing a second lifting strap through the second lifting connector. The method includes lifting the first hook block using the second lifting strap by the second lifting connector. The method also includes aligning the first hook block relative to the second end of the boom member. The method further includes hingedly coupling the first hook block to the second end of the boom member.

Other features and aspects of this disclosure will be apparent from the following description and the accompanying drawings.

DETAILED DESCRIPTION

Figure 1:
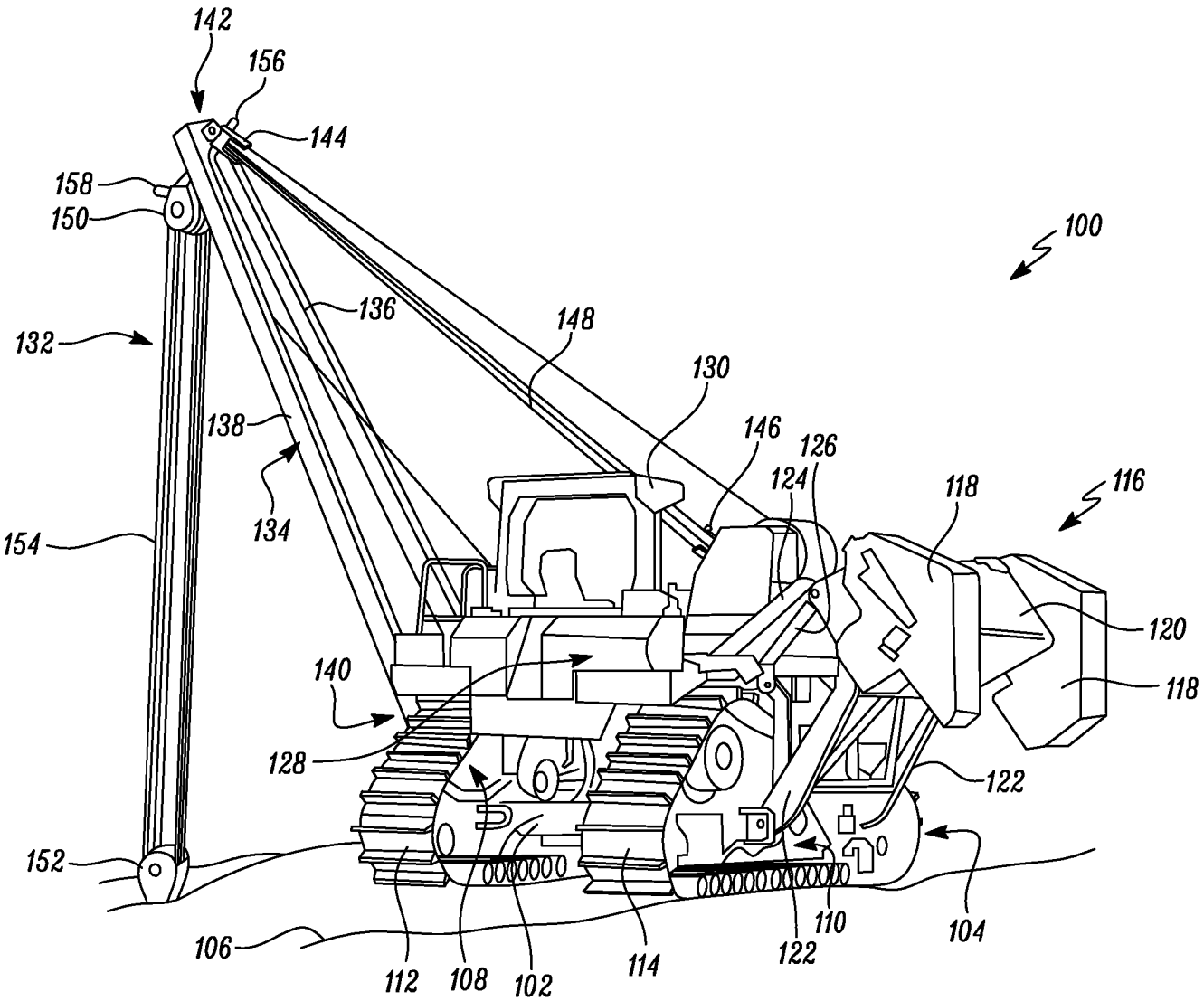
FIG. 1 is a perspective view of an exemplary pipelayer, according to one embodiment of the present disclosure.

Wherever possible, the same reference numbers will be used throughout the drawings to refer to the same or the like parts. Referring to FIG. 1, a perspective view of an exemplary pipelayer 100 is illustrated. The pipelayer 100 may be used to lift and/or lower a load, such as a conduit segment, a pipe segment, a culvert segment, a drainage segment, and so on, during a pipelaying operation. The pipelayer 100 includes a chassis 102. The chassis 102 supports one or more components of the pipelayer 100. The pipelayer 100 includes an undercarriage 104 operably coupled to the chassis 102. The undercarriage 104 supports the pipelayer 100 on ground surface 106.

The undercarriage 104 includes a set of track roller frames, such as a first track roller frame 108 and a second track roller frame 110. The first track roller frame 108 includes a first track 112, and the second track roller frame 110 includes a second track 114. Each of the first track 112 and the second track 114 supports and provides mobility to the pipelayer 100 on the ground surface 106. Additionally, each of the first track roller frame 108 and the second track roller frame 110 may include additional components (not shown), such as a drive sprocket, one or more idlers, one or more rollers, and so on, based on application requirements.

The pipelayer 100 also includes a counterweight system 116. The counterweight system 116 is disposed adjacent to the second track roller frame 110. The counterweight system 116 includes one or more counterweights 118 disposed on a counterweight frame 120. The counterweight frame 120 is movably coupled to the pipelayer 100 using a set of arms, such as lower arms 122 and upper arms 124 (only one upper arm shown in the accompanying figure). More specifically, each of the lower arms 122 are movably coupled to each of the second track roller frame 110 and the counterweight frame 120. Also, each of the upper arms 124 are movably coupled to each of the chassis 102 and the counterweight frame 120. Additionally, the counterweight system 116 includes one or more actuators, such as a hydraulic actuator 126, operably coupled between the chassis 102 and the counterweight frame 120. Based on an operation of the hydraulic actuator 126, the counterweight frame 120 and the counterweights 118 are adapted to move between a retracted position (shown in the accompanying figure) and an extended position (not shown) relative to the chassis 102 of the pipelayer 100. As such, based on the position of the counterweights 118, the counterweight system 116 is adapted to provide a variable load lifting capacity of the pipelayer 100.

The pipelayer 100 includes an enclosure 128 mounted on the chassis 102. The enclosure 128 houses a power source (not shown), such as an engine, batteries, and the like, of the pipelayer 100. The power source provides power to the pipelayer 100 for operational and mobility requirements. The pipelayer 100 also includes an operator cabin 130 mounted on the chassis 102. The operator cabin 130 includes various controls (not shown), such as a steering, a joystick, an operator console, an operator seat, levers, pedals, buttons, switches, knobs, and the like. The controls are adapted to control the pipelayer 100 on the ground surface 106 and during the pipelaying operation. Additionally, the pipelayer 100 may include one or more components and/or systems (not shown), such as a propulsion system, a drivetrain, a hydraulic system, a fuel control system, an engine control system, an air delivery system, a lubrication system, a cooling system, a drive control system, a machine control system, and so on, based on application requirements.

The pipelayer 100 further includes a boom assembly 132 operably coupled to the undercarriage 104 and the chassis 102. The boom assembly 132 is adapted to lift and lower the load during the pipelaying operation. It should be noted that although the boom assembly 132 is described herein with reference to the pipelayer 100, in other embodiments, the boom assembly 132 may be adapted to be employed on any other lifting machine, such as a crane. The boom assembly 132 includes a boom member 134. In the illustrated embodiment, the boom member 134 includes two leg segments, such as a first leg segment 136 and a second leg segment 138. As such, in the illustrated embodiment, the boom member 134 has a substantially elongated and triangular configuration. In other embodiments, the boom member 134 may include single or multiple leg segments, based on application requirements.

Figure 4A:
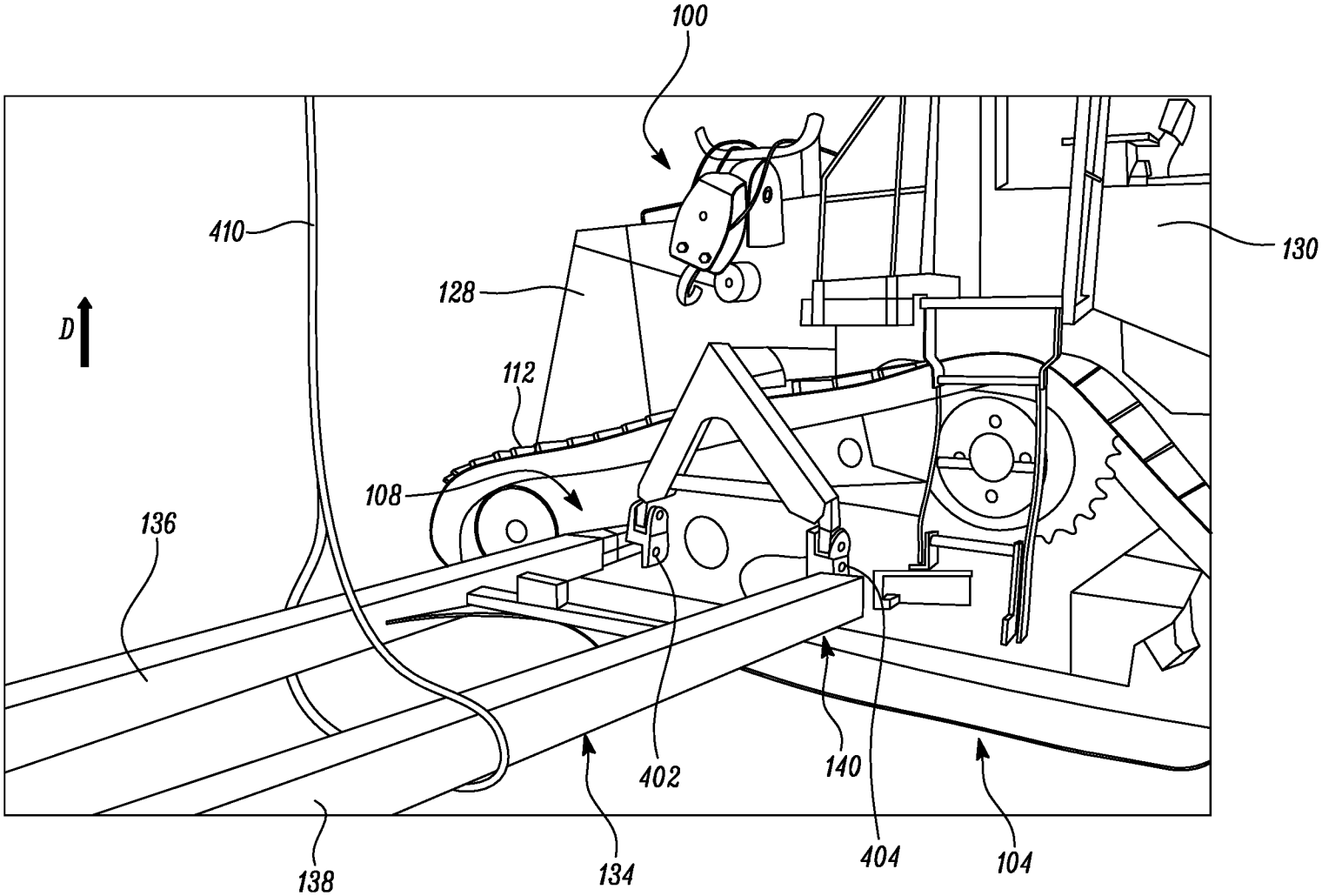
FIGS. 4A, 4B, 4C, and 4D are perspective views showing different stages of assembly of a boom assembly on the pipelayer, according to one embodiment of the present disclosure.

The boom member 134 includes a first end 140 and a second end 142. The second end 142 is disposed opposite to the first end 140. The first end 140 is removably coupled to the undercarriage 104 of the pipelayer 100. More specifically, the first end 140 of the boom member 134 is removably and hingedly coupled to the first track roller frame 108 using two first hinge pins 402, 404 (shown in FIG. 4A). As such, the first hinge pin 402 removably and hingedly couples the first leg segment 136 to the first track roller frame 108. Also, the first hinge pin 404 removably and hingedly couples the second leg segment 138 to the first track roller frame 108. Further, the first leg segment 136 and the second leg segment 138 are connected to each other at the second end 142.

The boom assembly 132 includes a first boom block 144. The first boom block 144 is removably coupled to the second end 142 of the boom member 134. More specifically, the first boom block 144 is removably and hingedly coupled to the second end 142 of the boom member 134 using a second hinge pin 202 (shown in FIG. 2A). The boom assembly 132 includes a second boom block 146 removably coupled to the chassis 102 of the pipelayer 100. More specifically, the second boom block 146 is removably and hingedly coupled to the chassis 102 using a hinge pin (not shown). The second boom block 146 is operably coupled to the first boom block 144 using at least one first cable 148. The first cable 148 may be further operably coupled to a winch (not shown) disposed on the chassis 102. Accordingly, based on an operation of the winch, the first cable 148 may be retracted or extended in order to raise or lower the second end 142 of the boom member 134, respectively, relative to the ground surface 106.

The boom assembly 132 includes a first hook block 150 removably coupled to the second end 142 of the boom member 134. The first hook block 150 is disposed opposite to the first boom block 144 on the second end 142 of the boom member 134. More specifically, the first hook block 150 is removably and hingedly coupled to the second end 142 of the boom member 134 using a third hinge pin 302 (shown in FIG. 3A). The boom assembly 132 includes a second hook block 152 operably coupled to the first hook block 150 using at least one second cable 154. The second cable 154 may be further operably coupled to a winch (not shown) disposed on the chassis 102. Accordingly, based on an operation of the winch, the second cable 154 may be retracted or extended in order to raise or lower the second hook block 152, respectively, relative to the ground surface 106.

The boom assembly 132 also includes a first lifting connector 156. The first lifting connector 156 will be hereinafter interchangeably referred to as the "first connector 156". The first connector 156 is disposed on the first boom block 144. Referring to FIG. 2A, the first connector 156 is fixedly coupled to a body 204 of the first boom block 144. More specifically, in the illustrated embodiment, the first connector 156 includes a first base plate 206 fixedly coupled to the body 204 of the first boom block 144, such as by welding. Further, the first connector 156 includes a first lifting eye 208 hingedly coupled to the first base plate 206.

Figure 2B:
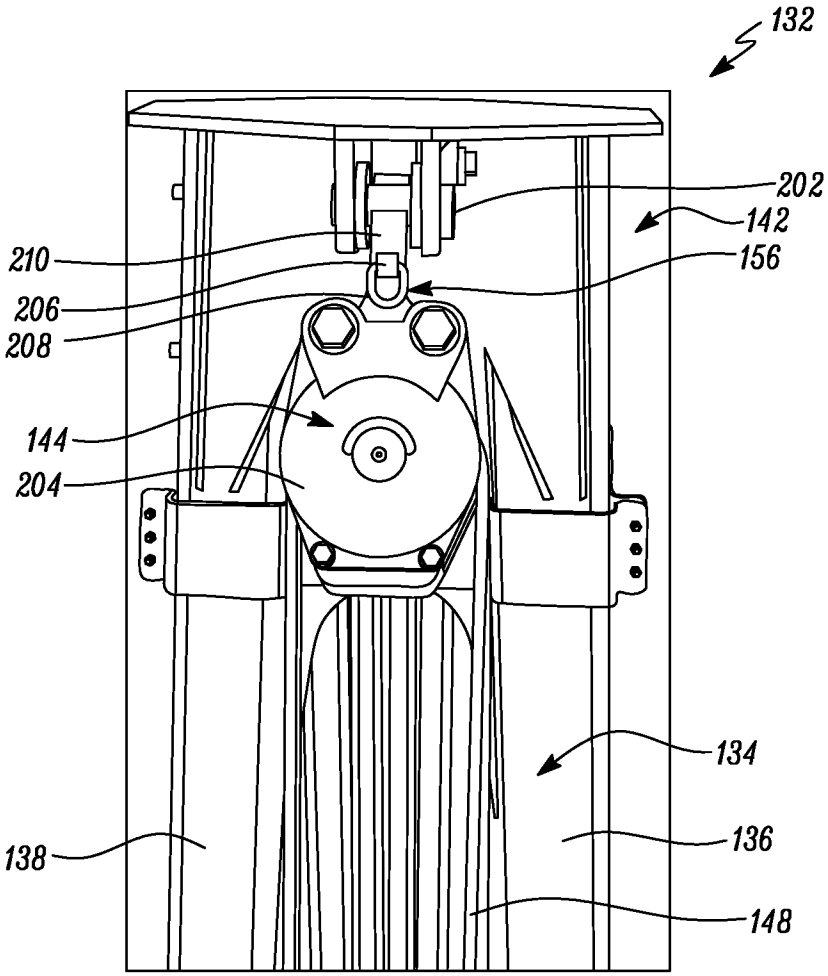
FIGS. 2A, 2B, 2C, and 2D are side views of a portion of the pipelayer showing a first lifting connector disposed on a first boom block of the pipelayer, according to different embodiments of the present disclosure.
Figure 2A:
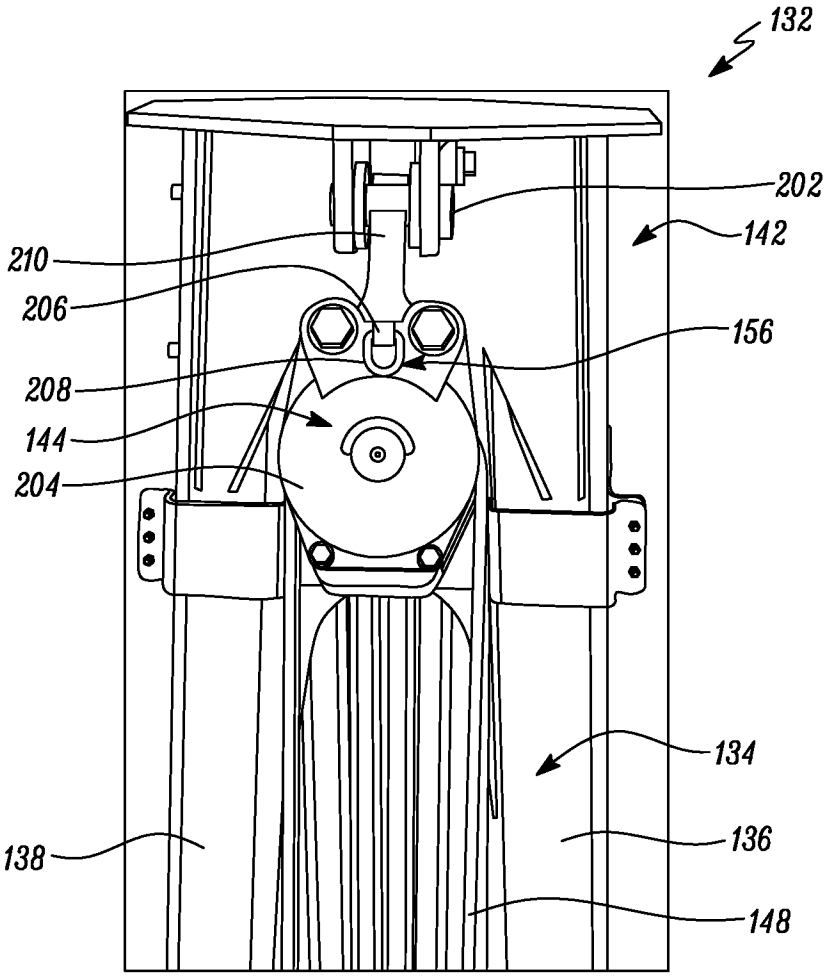

In another embodiment, referring to FIG. 2B, the first connector 156 is fixedly coupled to a yoke 210 of the first boom block 144. More specifically, in the illustrated embodiment, the first base plate 206 of the first connector 156 is fixedly coupled to the yoke 210 of the first boom block 144, such as by welding. Further, the first lifting eye 208 of the first connector 156 is hingedly coupled to the first base plate 206. In some embodiments (not shown), the first lifting eye 208 may be fixedly coupled to the body 204 or the yoke 210 of the first boom block 144. In such a situation, the first base plate 206 may be omitted.

Figure 2D:
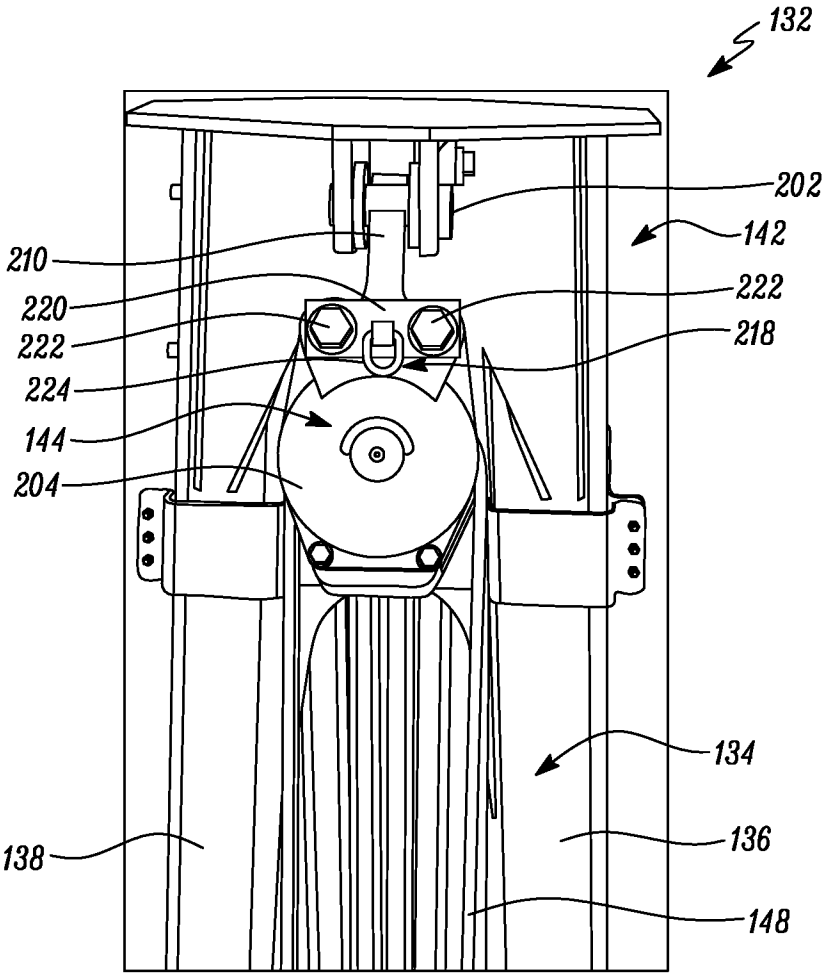
Figure 2C:
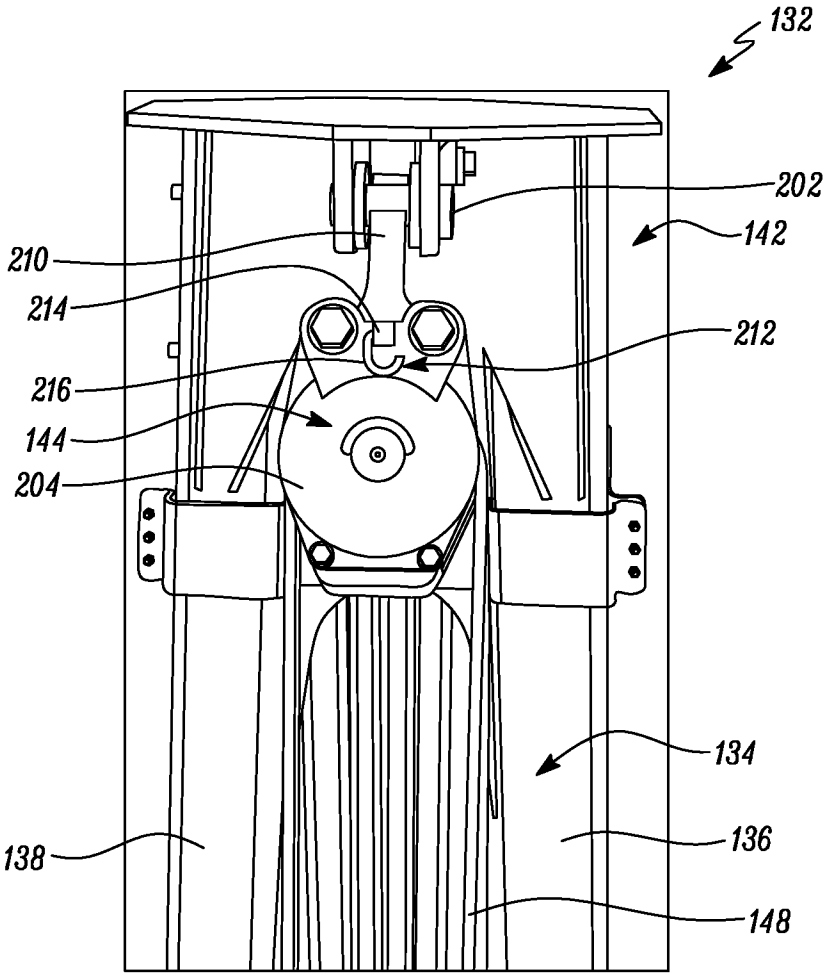

In another embodiment, referring to FIG. 2C, a first connector 212 is fixedly coupled to the body 204 of the first boom block 144. More specifically, in the illustrated embodiment, the first connector 212 includes a first base plate 214 fixedly coupled to the body 204 of the first boom block 144, such as by welding. Further, the first connector 212 includes a first lifting hook 216 hingedly coupled to the first base plate 214. In some embodiments (not shown), the first connector 212 may be fixedly coupled to the yoke 210 of the first boom block 144. In some embodiments (not shown), the first lifting hook 216 may be fixedly coupled to the body 204 or the yoke 210 of the first boom block 144. In such a situation, the first base plate 214 may be omitted. In some embodiments, the first lifting eye 208 or the first lifting hook 216 may be removably coupled, such as by bolting, to the body 204 using a boss member (not shown) disposed on the body 204. In yet some embodiments, the first lifting eye 208 or the first lifting hook 216 may be removably coupled, such as by bolting, to the yoke 210 using a boss member (not shown) disposed on the yoke 210.

In another embodiment, referring to FIG. 2D, a first connector 218 is removably coupled to the body 204 of the first boom block 144. More specifically, in the illustrated embodiment, the first connector 218 includes a first adapter plate 220 removably coupled to the body 204 of the first boom block 144, such as using fasteners 222. Further, the first connector 218 includes a first lifting eye 224 hingedly coupled to the first adapter plate 220. In some embodiments (not shown), the first connector 218 may include a first lifting hook (as described with reference to FIG. 2C) hingedly coupled to the first adapter plate 220. The first connector 156, 212, 218 is adapted to receive a lifting strap, such as a first lifting strap 406 (shown in FIG. 4B), therethrough.

Referring to FIG. 1, the boom assembly 132 further includes a second lifting connector 158. The second lifting connector 158 will be hereinafter interchangeably referred to as the "second connector 158". The second connector 158 is disposed on the first hook block 150. Referring to FIG. 3A, the second connector 158 is fixedly coupled to a body 304 of the first hook block 150. More specifically, in the illustrated embodiment, the second connector 158 includes a second base plate 306 fixedly coupled to the body 304 of the first hook block 150, such as by welding. Further, the second connector 158 includes a second lifting eye 308 hingedly coupled to the second base plate 306.

Figure 3B:
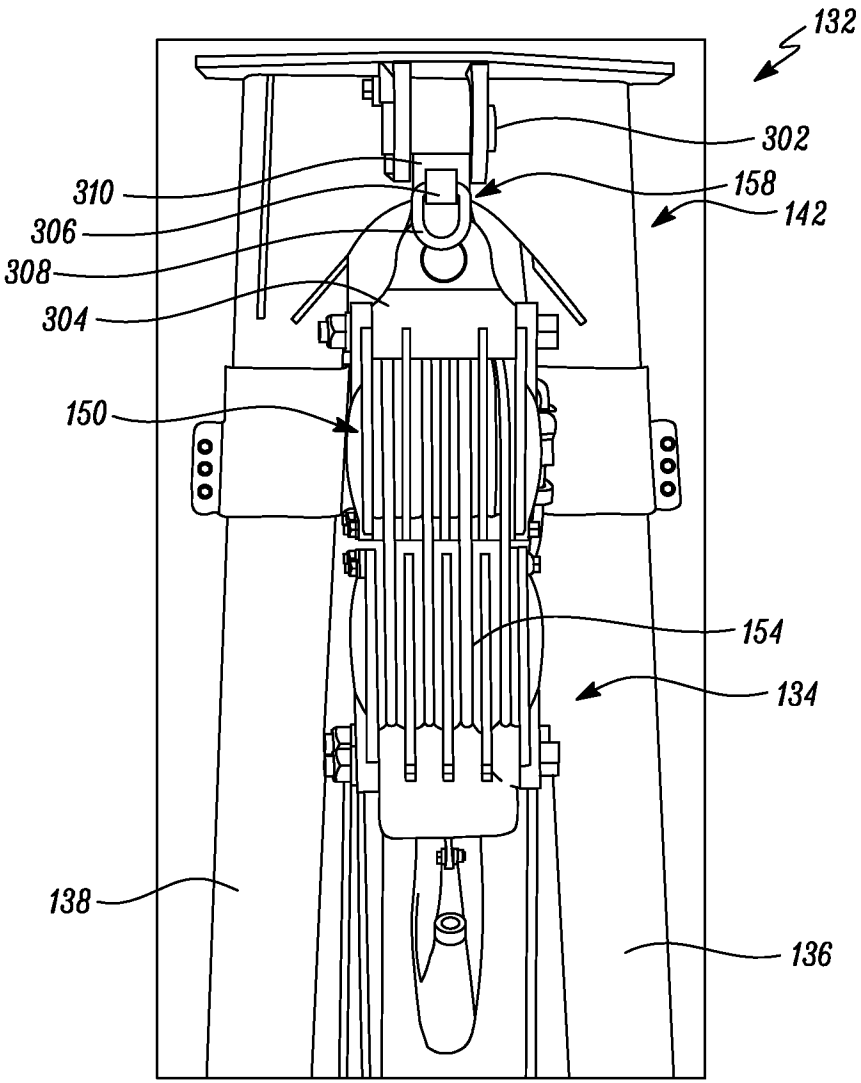
FIGS. 3A, 3B, 3C, and 3D are side views of a portion of the pipelayer showing a second lifting connector disposed on a first hook block of the pipelayer, according to different embodiments of the present disclosure.
Figure 3A:
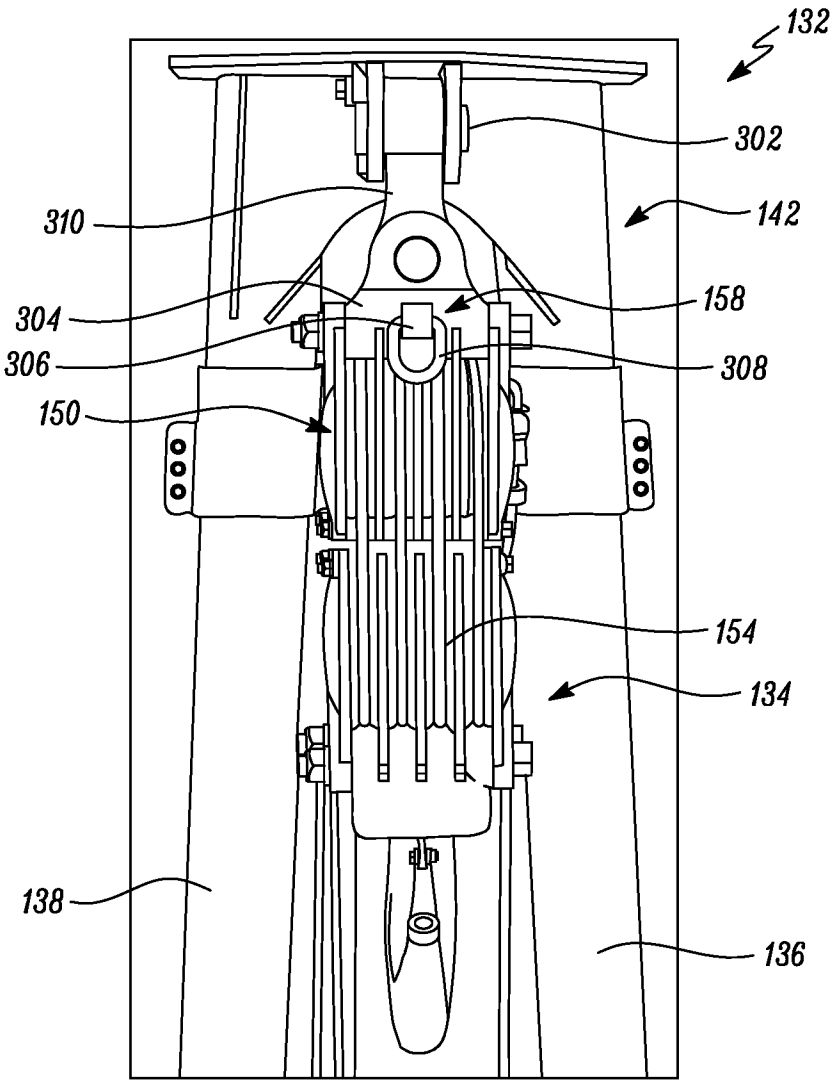

In another embodiment, referring to FIG. 3B, the second connector 158 is fixedly coupled to a yoke 310 of the first hook block 150. More specifically, in the illustrated embodiment, the second base plate 306 of the second connector 158 is fixedly coupled to the yoke 310 of the first hook block 150, such as by welding. Further, the second lifting eye 308 of the second connector 158 is hingedly coupled to the second base plate 306. In some embodiments (not shown), the second lifting eye 308 may be fixedly coupled to the body 304 or the yoke 310 of the first hook block 150. In such a situation, the second base plate 306 may be omitted.

Figure 3D:
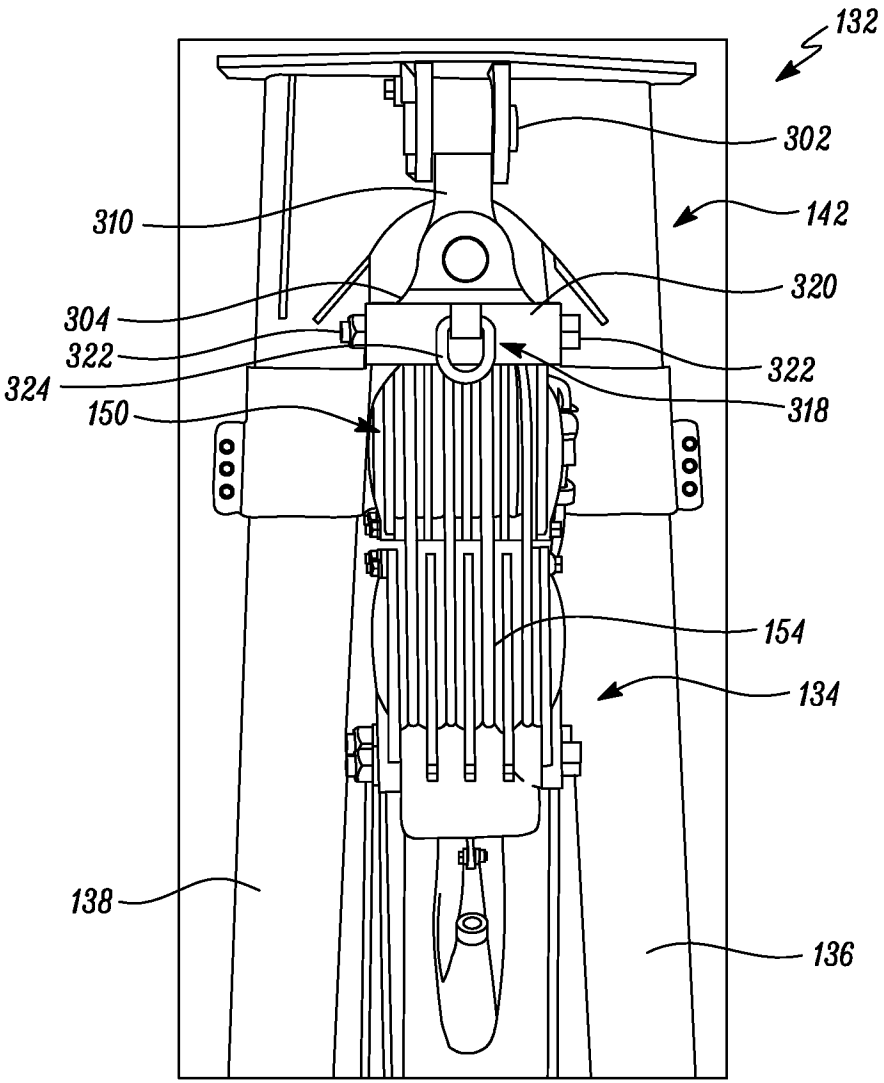
Figure 3C:
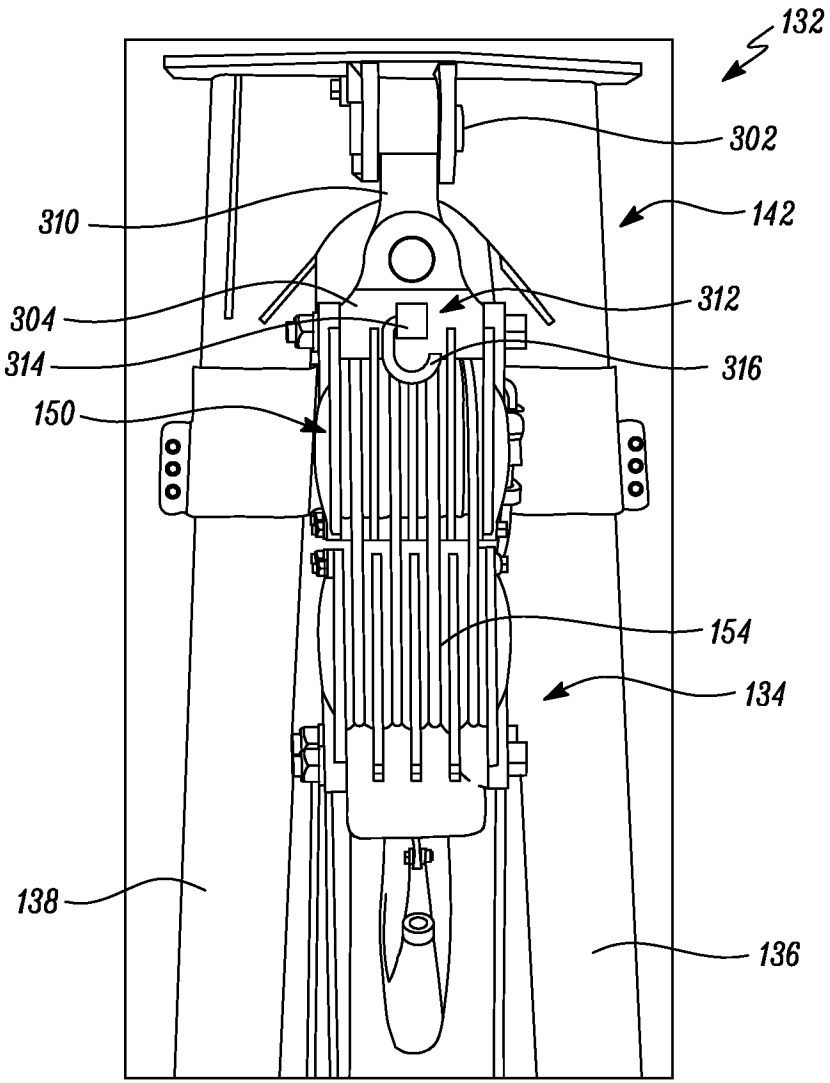

In another embodiment, referring to FIG. 3C, a second connector 312 is fixedly coupled to the body 304 of the first hook block 150. More specifically, in the illustrated embodiment, the second connector 312 includes a second base plate 314 fixedly coupled to the body 304 of the first hook block 150, such as by welding. Further, the second connector 312 includes a second lifting hook 316 hingedly coupled to the second base plate 314. In some embodiments (not shown), the second connector 312 may be fixedly coupled to the yoke 310 of the first hook block 150. In some embodiments (not shown), the second lifting hook 316 may be fixedly coupled to the body 304 or the yoke 310 of the first hook block 150. In such a situation, the second base plate 314 may be omitted. In some embodiments, the second lifting eye 308 or the second lifting hook 316 may be removably coupled, such as by bolting, to the body 304 using a boss member (not shown) disposed on the body 304. In yet some embodiments, the second lifting eye 308 or the second lifting hook 316 may be removably coupled, such as by bolting, to the yoke 310 using a boss member (not shown) disposed on the yoke 310.

In another embodiment, referring to FIG. 3D, a second connector 318 is removably coupled to the body 304 of the first hook block 150. More specifically, in the illustrated embodiment, the second connector 318 includes a second adapter plate 320 removably coupled to the body 304 of the first hook block 150, such as using fasteners 322. Further, the second connector 318 includes a second lifting eye 324 hingedly coupled to the second adapter plate 320. In some embodiments (not shown), the second connector 318 may include a second lifting hook (as described with reference to FIG. 3C) hingedly coupled to the second adapter plate 320. The second connector 158, 312, 318 is adapted to receive a lifting strap, such as a second lifting strap 408 (shown in FIG. 4C), therethrough.

INDUSTRIAL APPLICABILITY

The present disclosure relates to a method of assembling the boom assembly 132 on the pipelayer 100. Referring to FIGS. 4A, 4B, 4C, and 4D, various stages of assembly of the boom assembly 132 on the pipelayer 100 are illustrated. Referring to FIG. 5, a flowchart of a method 500 of assembling the boom assembly 132 on the pipelayer 100 is illustrated. The method 500 will now be explained with combined reference to FIGS. 4A to 4D. At step 502 and referring to FIG. 4A, the first end 140 of the boom member 134 is aligned relative to the undercarriage 104 of the pipelayer 100. More specifically, a boom lifting strap 410 is provided around the boom member 134 in order to secure the boom member 134. The boom lifting strap 410 is further coupled to a lifting machine (not shown), such as an excavator, a crane, and so on.

The lifting machine is then operated in order to lift and move the boom member 134 using the boom lifting strap 410. Further, the first end 140 of the boom member 134 is aligned adjacent to the first track roller frame 108 using the boom lifting strap 410 and the lifting machine. At step 504 and still referring to FIG. 4A, the first end 140 of the boom member 134 is hingedly coupled to the undercarriage 104 using at least one first hinge pin 402, 404. More specifically, the first leg segment 136 of the boom member 134 is hingedly coupled to the first track roller frame 108 using the first hinge pin 402. Also, the second leg segment 138 of the boom member 134 is hingedly coupled to the first track roller frame 108 using the first hinge pin 404. As such, the boom member 134 may hingedly move in a direction "D" about each of the first hinge pins 402, 404. The boom lifting strap 410 may be then removed from the boom member 134 and/or the lifting machine.

At step 506 and referring to FIG. 4B, the first lifting connector 156, as described with reference to FIG. 2A, is provided on the first boom block 144. It should be noted that, in other embodiments, any of the first lifting connector 156, 212, 218, as described with reference to FIGS. 2B, 2C, and 2D, respectively, may be provided on the first boom block 144. At step 508 and still referring to FIG. 4B, the first lifting strap 406 is provided through the first lifting connector 156 in order to secure the first lifting strap 406 to the first boom block 144. The first lifting strap 406 is further coupled to the lifting machine. At step 510 and still referring to FIG. 4B, the first boom block 144 is lifted by the first lifting connector 156 using the first lifting strap 406. More specifically, the lifting machine is operated in order to lift and move the first boom block 144 by the first lifting connector 156 using the first lifting strap 406.

Figure 4B:
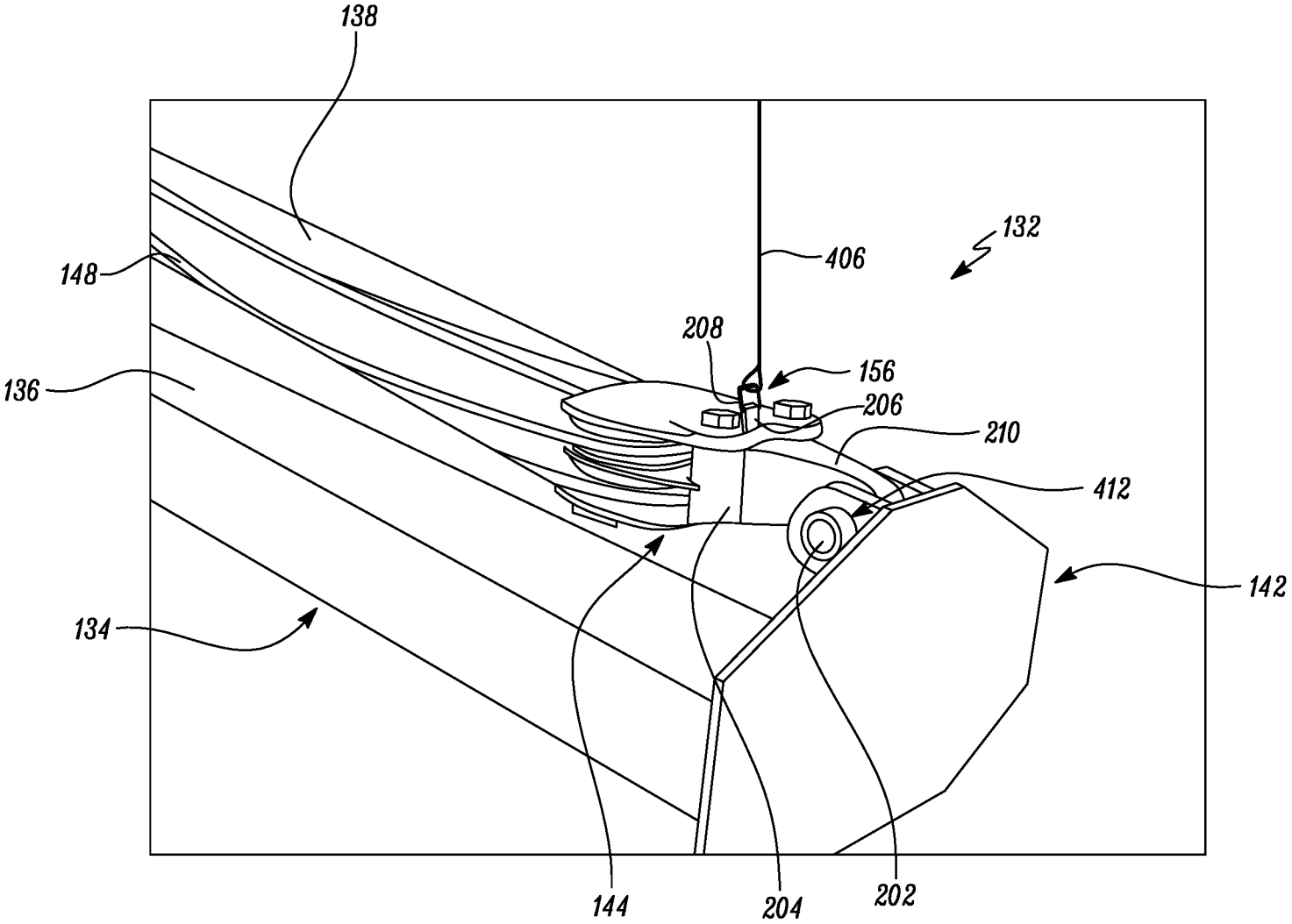
Figure 5:
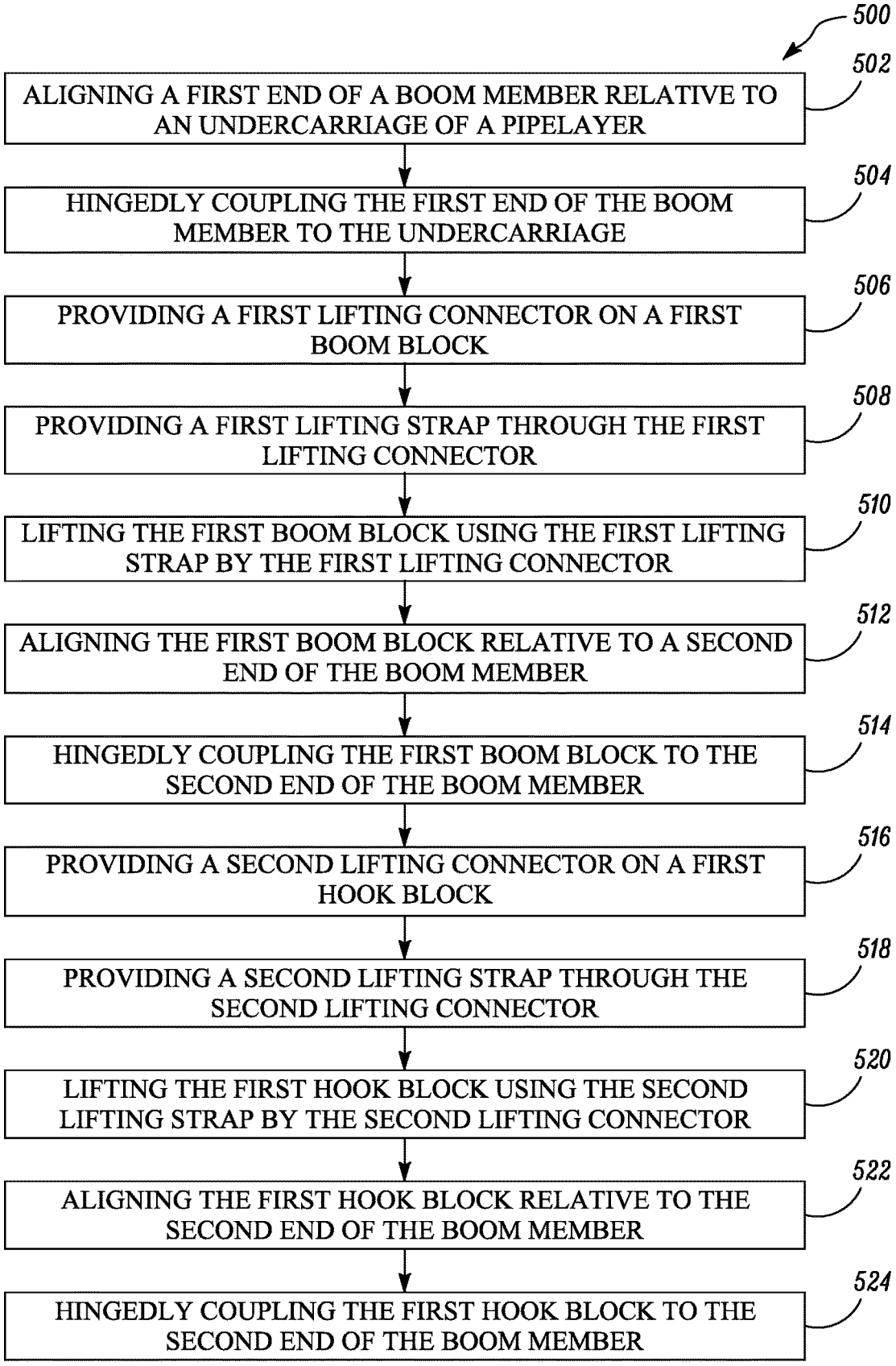
FIG. 5 is a flowchart illustrating a method of assembling the boom assembly on the pipelayer, according to one embodiment of the present disclosure.

At step 512 and still referring to FIG. 4B, the first boom block 144 is aligned relative to the second end 142 of the boom member 134. More specifically, the yoke 210 of the first boom block 144 is aligned with a first bore 412 provided on the second end 142 of the boom member 134. At step 514 and still referring to FIG. 4B, the first boom block 144 is hingedly coupled to the second end 142 of the boom member 134. More specifically, the second hinge pin 202 is disposed within the first bore 412 and through the yoke 210 in order to hingedly couple the first boom block 144 to the second end 142 of the boom member 134. Further, the first lifting strap 406 is removed from the first lifting connector 156 of the first boom block 144.

At step 516 and referring to FIG. 4C, the second lifting connector 158, as described with reference to FIG. 3A, is provided on the first hook block 150. It should be noted that, in other embodiments, any of the second lifting connector 158, 312, 318, as described with reference to FIGS. 3B, 3C, and 3D, respectively, may be provided on the first hook block 150. At step 518 and still referring to FIG. 4C, the second lifting strap 408 is provided through the second lifting connector 158 in order to secure the second lifting strap 408 to the first hook block 150. The second lifting strap 408 is further coupled to the lifting machine. It should be noted that, in some situations, the second lifting strap 408 may be same as the first lifting strap 406, such that the first lifting strap 406 may be removed from the first lifting connector 156 and coupled to the second lifting connector 158 and the lifting machine.

Figure 4C:
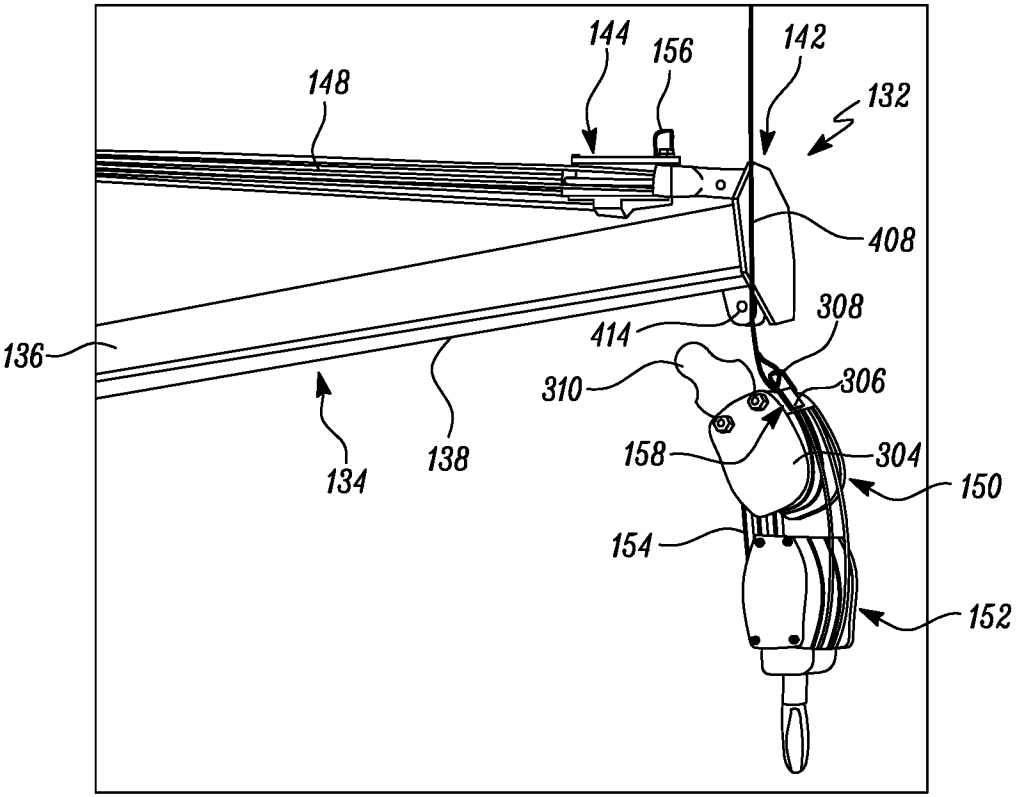
Figure 4D:
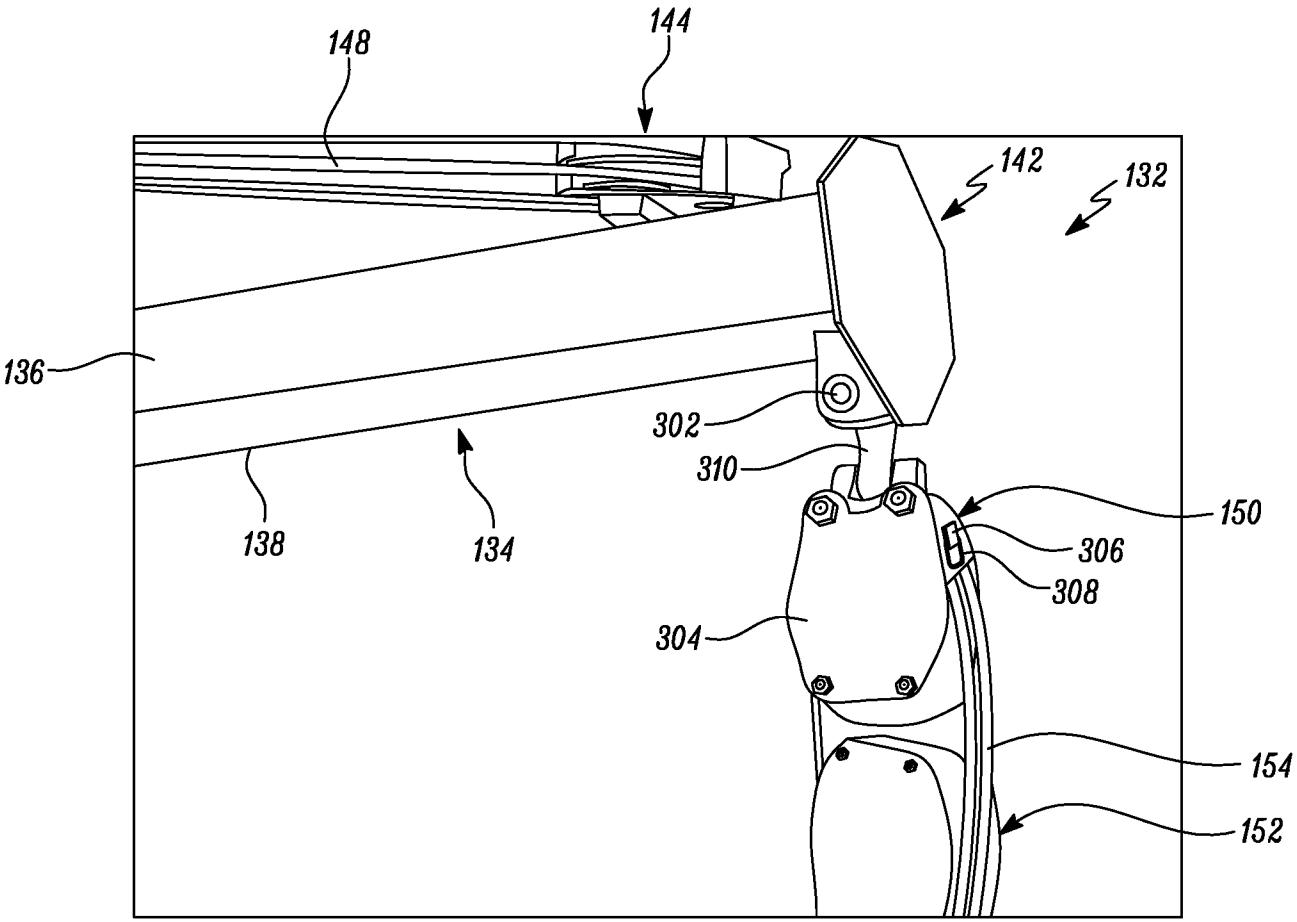

At step 520 and still referring to FIG. 4C, the first hook block 150 is lifted by the second lifting connector 158 using the second lifting strap 408. More specifically, the lifting machine is operated in order to lift and move the first hook block 150 by the second lifting connector 158 using the second lifting strap 408. At step 522 and referring to FIG. 4D, the first hook block 150 is aligned relative to the second end 142 of the boom member 134. Also, the first hook block 150 is aligned opposite to the first boom block 144. More specifically, the yoke 310 of the first hook block 150 is aligned with a second bore 414 provided on the second end 142 of the boom member 134.

In some situations, as shown in the accompanying figures, the second end 142 of the boom member 134 is lifted relative to the ground surface 106 in order to provide improved workability around the second end 142 of the boom member 134. More specifically, the first cable 148 operably coupled between the first boom block 144 and the second boom block 146 may be operated using the respective winch in order to lift the second end 142 of the boom member 134 relative to the ground surface 106. At step 524 and still referring to FIG. 4D, the first hook block 150 is hingedly coupled to the second end 142 of the boom member 134 and opposite to the first boom block 144. More specifically, the third hinge pin 302 is disposed within the second bore 414 and through the yoke 310 in order to hingedly couple the first hook block 150 to the second end 142 of the boom member 134. Further, the second lifting strap 408 is removed from the second lifting connector 158 of the first hook block 150.

Each of the first connector 156, 212, 218 and the second connector 158, 312, 318 provides a simple, effective, and cost-efficient method of securing the first boom block 144 and the first hook block 150, respectively, to the respective lifting strap. As such, each of the first connector 156, 212, 218 and the second connector 158, 312, 318 may be securely lifted and moved during assembly of the boom assembly 132. Accordingly, a possibility of dropping the first connector 156, 212, 218 and the second connector 158, 312, 318 during assembly of the boom assembly 132 may be reduced, in turn, improving safety and reducing damage related costs.

Each of the first connector 156, 212, 218 and the second connector 158, 312, 318 includes a simple design and may be available as off-the-shelf components, in turn, reducing complexity and costs. The first connector 156, 212, 218 and the second connector 158, 312, 318 may be provided on any boom block and/or hook block with little or no modification to existing design, in turn, improving flexibility and compatibility. Further, the method 500 provides a simple, effective, and systematic process for assembling the boom assembly 132 on the pipelayer 100, in turn, reducing labor effort, reducing assembly time, reducing machine downtime, and reducing costs.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A boom assembly for a pipelayer, the boom assembly comprising:

a boom member having a first end and a second end disposed opposite to the first end, the first end of the boom member adapted to be removably coupled to an undercarriage of the pipelayer;

a first boom block adapted to be removably coupled to the second end of the boom member;

a second boom block adapted to be removably coupled to a chassis of the pipelayer and operably coupled to the first boom block using at least one first cable;

a first hook block adapted to be removably coupled to the second end of the boom member and disposed opposite to the first boom block;

a second hook block adapted to be operably coupled to the first hook block using at least one second cable;

a first lifting connector disposed on the first boom block; and a second lifting connector disposed on the first hook block, wherein each of the first lifting connector and the second lifting connector is adapted to removably receive a lifting strap therethrough.

2. The boom assembly of claim 1, wherein the first lifting connector is coupled to any one of a body and a yoke of the first boom block.

3. The boom assembly of claim 1, wherein the first lifting connector is coupled to the first boom block using a first adapter plate.

4. The boom assembly of claim 1, wherein the second lifting connector is coupled to any one of a body and a yoke of the first hook block.

5. The boom assembly of claim 1, wherein the second lifting connector is coupled to the first hook block using a second adapter plate.

6. The boom assembly of claim 1, wherein the first lifting connector is any one of a lifting eye and a lifting hook.

7. The boom assembly of claim 1, wherein the second lifting connector is any one of a lifting eye and a lifting hook.

8. A pipelayer comprising:

a chassis;

an undercarriage coupled to the chassis;

a boom member having a first end and a second end disposed opposite to the first end, the first end of the boom member adapted to be removably coupled to the undercarriage;

a first boom block adapted to be removably coupled to the second end of the boom member;

a second boom block adapted to be removably coupled to the chassis and operably coupled to the first boom block using at least one first cable;

a first hook block adapted to be removably coupled to the second end of the boom member and disposed opposite to the first boom block;

a second hook block adapted to be operably coupled to the first hook block using at least one second cable;

a first lifting connector disposed on the first boom block; and a second lifting connector disposed on the first hook block, wherein each of the first lifting connector and the second lifting connector is adapted to removably receive a lifting strap therethrough.

9. The pipelayer of claim 8, wherein the first lifting connector is coupled to any one of a body and a yoke of the first boom block.

10. The pipelayer of claim 8, wherein the first lifting connector is coupled to the first boom block using a first adapter plate.

11. The pipelayer of claim 8, wherein the second lifting connector is coupled to any one of a body and a yoke of the first hook block.

12. The pipelayer of claim 8, wherein the second lifting connector is coupled to the first hook block using a second adapter plate.

13. The pipelayer of claim 8, wherein the first lifting connector is any one of a lifting eye and a lifting hook.

14. The pipelayer of claim 8, wherein the second lifting connector is any one of a lifting eye and a lifting hook.

15. A method for assembling a boom assembly on a pipelayer, the method comprising:

aligning a first end of a boom member relative to an undercarriage of the pipelayer;

coupling, hingedly, the first end of the boom member to the undercarriage;

providing a first lifting connector on a first boom block;

providing a first lifting strap through the first lifting connector;

lifting, by the first lifting connector, the first boom block using the first lifting strap;

aligning the first boom block relative to a second end of the boom member;

coupling, hingedly, the first boom block to the second end of the boom member;

providing a second lifting connector on a first hook block;

providing a second lifting strap through the second lifting connector;

lifting, by the second lifting connector, the first hook block using the second lifting strap;

aligning the first hook block relative to the second end of the boom member; and coupling, hingedly, the first hook block to the second end of the boom member.

16. The method of claim 15, wherein aligning the first hook block further includes lifting the second end of the boom member relative to ground surface by operating at least one first cable operably coupled between the first boom block and a second boom block.

17. The method of claim 15, wherein aligning the first end of the boom member further includes:

providing a boom lifting strap around the boom member; and lifting the boom member using the boom lifting strap.

18. The method of claim 17 further includes:

removing the boom lifting strap from the boom member;

removing the first lifting strap from the first lifting connector of the first boom block; and removing the second lifting strap from the second lifting connector of the first hook block.

19. The method of claim 15, wherein the first end of the boom member is hingedly coupled to the undercarriage using at least one first hinge pin.

20. The method of claim 15, wherein:

the first boom block is hingedly coupled to the second end of the boom member using a second hinge pin, and the first hook block is hingedly coupled to the second end of the boom member using a third hinge pin.

* * * * *